US008857087B1

(12) United States Patent
Wildrick et al.

(10) Patent No.: US 8,857,087 B1
(45) Date of Patent: Oct. 14, 2014

(54) LABEL HOLDER AND SIGN HOLDER SYSTEM FOR MERCHANDISE DISPLAY SHELVES

(71) Applicants: Richard J. Wildrick, Hunlock Creek, PA (US); Marc D. Huntington, Berwick, PA (US)

(72) Inventors: Richard J. Wildrick, Hunlock Creek, PA (US); Marc D. Huntington, Berwick, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 13/968,894

(22) Filed: Aug. 16, 2013

(51) Int. Cl.
*G09F 3/18* (2006.01)
*G09F 3/16* (2006.01)
*G09F 3/20* (2006.01)

(52) U.S. Cl.
CPC . *G09F 3/16* (2013.01); *G09F 3/204* (2013.01)
USPC ..... 40/661.03

(58) Field of Classification Search
CPC ..... G09F 3/204
USPC ..... 40/647, 661.01, 661.03
See application file for complete search history.

(56) References Cited

U.S. PATENT DOCUMENTS 4,557,064 A * 12/1985 Thompson ..... 40/661.03
4,718,627 A * 1/1988 Fast et al. ..... 248/222.12
5,967,343 A * 10/1999 Dufresne ..... 211/86.01
6,026,603 A * 2/2000 Kump et al. ..... 40/661.03
6,266,906 B1 7/2001 Nagel
6,354,546 B1 * 3/2002 Mueller ..... 248/220.42
6,698,124 B2 * 3/2004 Kump et al. ..... 40/642.02
6,708,436 B2 3/2004 Nagel
6,971,201 B2 12/2005 Brinkman et al.
D531,227 S 10/2006 Mueller et al.
D546,892 S 7/2007 Bruegmann
7,325,348 B2 * 2/2008 Mueller et al. ..... 40/649
D573,656 S 7/2008 Wamsley
7,434,341 B2 10/2008 Brinkman et al.
7,627,971 B2 12/2009 Fast
7,836,621 B2 11/2010 Mueller et al.
2002/0029505 A1 * 3/2002 Faneuf ..... 40/658
2003/0163906 A1 * 9/2003 Wildrick ..... 24/459
2005/0167555 A1 * 8/2005 Wamsley ..... 248/231.81
2009/0320344 A1 * 12/2009 Barkdoll et al. ..... 40/661.03
2013/0061500 A1 3/2013 Bird et al.

* cited by examiner

*Primary Examiner* — Gary Hoge
(74) *Attorney, Agent, or Firm* — St. Onge Steward Johnston & Reens LLC

(57) ABSTRACT

A label holder and sign holder system for attachment along the front face of a merchandise display shelf. The label holder has a forwardly projecting, downwardly opening sign grip extending along its upper edge for receiving and gripping upper edges of sign cards, which can be positioned along the length of the label holder. A sign holder, which is narrow in relation to the label holder, has a mounting clip at its upper edge which snaps over the sign grip and releasably locks the sign holder to the label holder, while permitting the sign holder to be laterally adjusted along the label holder. The sign holder has a panel extending downward from the mounting clip and carrying a sign clip for displaying a sign at right angles to the label holder. When no sign is displayed, the sign holder can be left in position or moved to an inconspicuous location.

15 Claims, 5 Drawing Sheets

LABEL HOLDER AND SIGN HOLDER SYSTEM FOR MERCHANDISE DISPLAY SHELVES

FIELD OF THE INVENTION

The invention relates to a system for the display of pricing and other information at the front of merchandise display shelves.

BACKGROUND OF THE INVENTION

In the merchandising of products in stores, particularly but not limited to large chain stores, merchandise is often displayed on gondola shelves, where the items can be easily seen by customers and easily removed for placement in shopping carts or the like. It is conventional to secure label display strips to the front of such shelves, to receive and display pricing and other information of relevance to a prospective consumer. In addition, the store keeper frequently desires to temporarily highlight certain items, such as daily price specials, new products, etc. in a manner that will catch the shopper's attention. Typical methods of highlighting selected products involve attaching special signs to the front of the label holder and/or mounting sign holders on a shelf or label holder, carrying a sign card or the like disposed at right angles to front of the shelving with the information on the sign card facing a consumer as he or she walks along a store aisle.

A consistent problem with the use of conventional sign holders arises after the sign has served its purpose and is no longer needed. Typically, in such cases, the sign holder is removed and stored somewhere in the store until the next occasion for its use. In many cases, however, the sign holders become lost or misplaced, or are simply inconveniently located in the store, resulting in delay or outright failure in the placing of signs where and when they are intended to be placed by the storekeeper. Moreover, over time the unused sign holders can become damaged and/or discarded, resulting in unnecessary losses to the storekeeper.

SUMMARY OF THE INVENTION

In accordance with the invention, a novel and improved label holder and sign holder system is provided which incorporates a unique and particularly advantageous forms of label holder and sign holder. In the system of the invention, a clip-on label holder is provided along its upper edge with a sign grip portion that can receive a temporary sign on the front side of the label holder. The new sign holder is semi-permanently attached to the label holder so as to be always available for use. The sign holder of the invention is specially designed and associated with the label holder in such manner that the sign holder may be easily and quickly moved laterally along the label holder, without requiring detachment therefrom. Accordingly, when a sign has served its purpose and has been removed, the label holder can simply be slid laterally to an inconspicuous position on the label holder, where it will be instantly available for a subsequent use when needed or desired.

It is not infrequent that in a given length of shelving (along a 48 inch gondola shelf, for example) a merchant may want to highlight more than one item, in which case a plurality of sign clips and signs will be employed. A particular advantage of the system of the present invention resides in the fact that a plurality of the new sign holders may be semi-permanently mounted on a single label holder strip and easily shifted around by lateral sliding. Because the individual sign holders can be inconspicuously positioned, it becomes possible to retain two or three of them along and/or at the ends of a label holder strip of standard length.

In the system of the invention, a preferred form of label holder is an extruded plastic section of desired length, which is secured to the front panel of the shelf by a clip-on attachment to a rearwardly extending flange at a lower edge of the shelf front panel. The label holder includes a label display panel that extends upwardly over the front panel of the shelving and provides a space between the shelf front panel and the label display panel for receiving routine pricing and product information labels. At the top, the label holder is bent forwardly and downwardly to form an inverted U-shaped sign grip cavity which extends longitudinally along the upper edge margin of the label holder strip. One or more flexible elements are formed inside the cavity to grip and retain an upper edge portion of an inserted sign. The sign grip and flexible elements extend for the full length of the label holder strip, such that a sign may be inserted and retained anywhere along the length of the strip. This allows special product information, such as daily specials, to be easily aligned with particular products being displayed.

While the above described label holder strip enables special signs to be placed strategically in association with selected products, there often is a need to call extra attention to a product or product area by means of signs extending at right angles to the label holder. In accordance with an aspect of the invention, a novel form of sign holder is also provided, which attaches over the top of the label display strip and its sign-gripping cavity in a manner that allows easy repositioning of the sign holder by sliding it laterally along length of the label holder and also allows removal when necessary or desired but at the same time effectively prevents accidental dislodgment of the sign holder. The sign holder includes a sign clip mounting panel and a mounting clip portion formed along an upper margin of the panel. The mounting clip portion includes a back flange that extends downward, behind an upper margin of the label holder, associated top and front flanges that extend over the top and front of the sign-grip cavity, and a bottom flange that extends underneath a front wall of the cavity to secure the sign holder to the label holder. The front of the mounting clip portion is flexibly associated with the back flange thereof to enable the clip to be opened as necessary to install the clip, and also to remove the sign holder if desired. However, it is contemplated (and enabled by the invention) that the sign holders will, in many cases, remain attached to the label holders even when no signs, or fewer signs than sign holders, are being utilized.

In an advantageous form of the invention, the front face of the label holder is formed with an upwardly and forwardly inclined projection. Upper extremities of the sign clip mounting panel are also formed to lie at an angle corresponding to the angle of the inclined projection. These upper extremities of the sign clip mounting panel are resiliently urged into contact with the inclined projection on the label holder which tends to secure the sign holder in its desired position on label holder, both laterally and vertically.

For a more complete understanding of the above and other features and advantages of the invention, reference should be made to the following detailed description of a preferred embodiment and to the accompanying drawings.

DETAILED DESCRIPTION OF THE INVENTION

Figure 1:
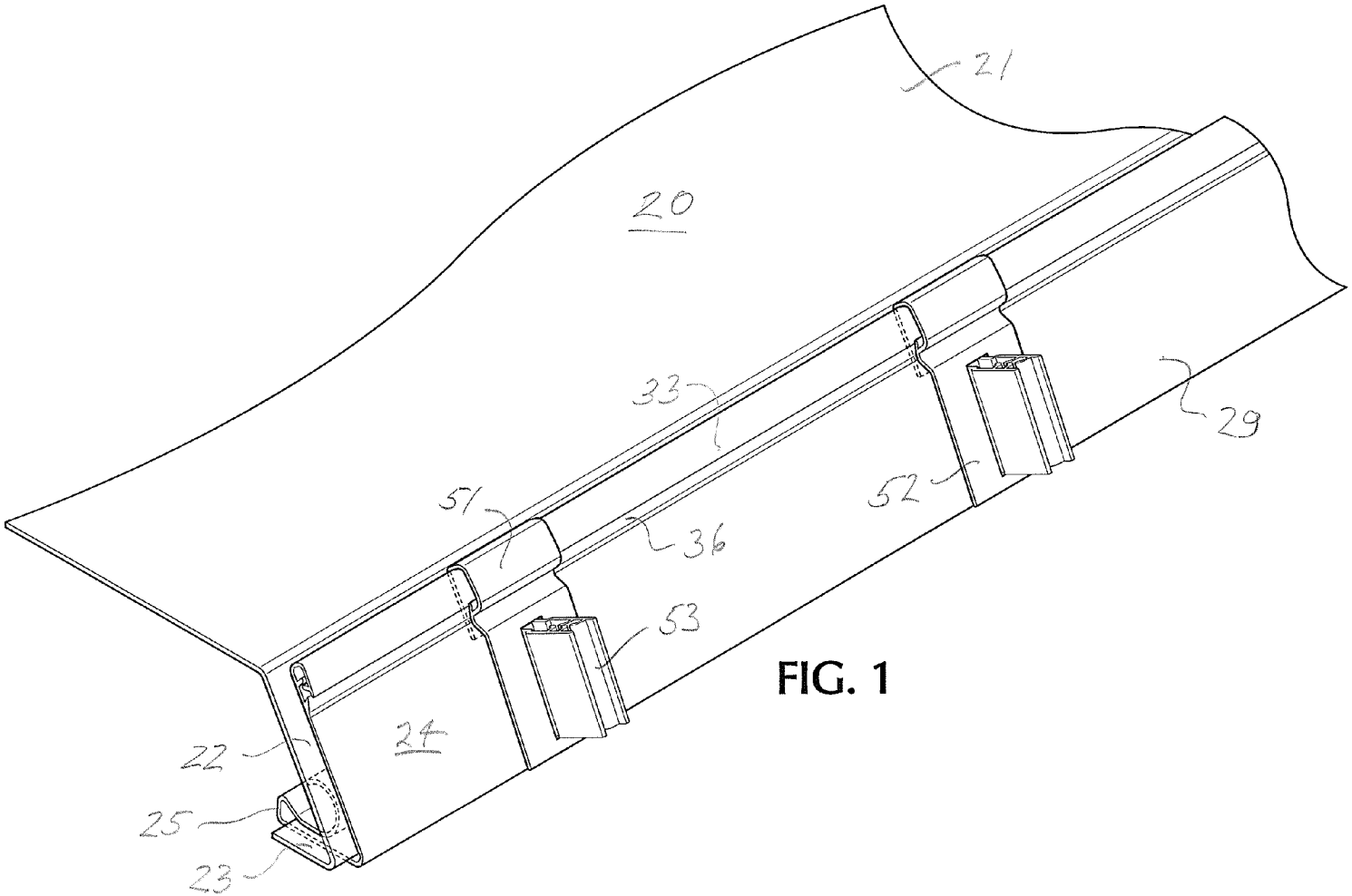
FIG. 1 is an orthographic view of a merchandise display shelf on which is mounted a label holder and sign holder system according to the invention.

Referring now to the drawings, the reference numeral 20 designates a typical form of merchandise display shelf which includes a flat, horizontal display surface 21, a downwardly and outwardly extending front edge panel 22, and a rearwardly extending bottom flange 23. The display shelf 20 typically is formed of metal and is quite rigid. A label holder 24 is mounted to the front of the display shelf 20 for the display of labels (not shown) containing pricing and other information relevant to merchandise (not shown) displayed on the shelf 20.

In the illustrated and preferred embodiment of the invention, the label holder 24 is formed of an extruded plastic material, such as rigid polyvinyl chloride, and includes a base clip 25 comprising a lower flange 26 and an upper flange 27 which between them grip the rearwardly extending bottom flange 23 of the shelf. Preferably, the upper flange 27 merges into an arcuate flange 28 which, when the label holder is properly positioned at the front of the shelf, bears against the back surface of the shelf front panel 22.

Figure 2:
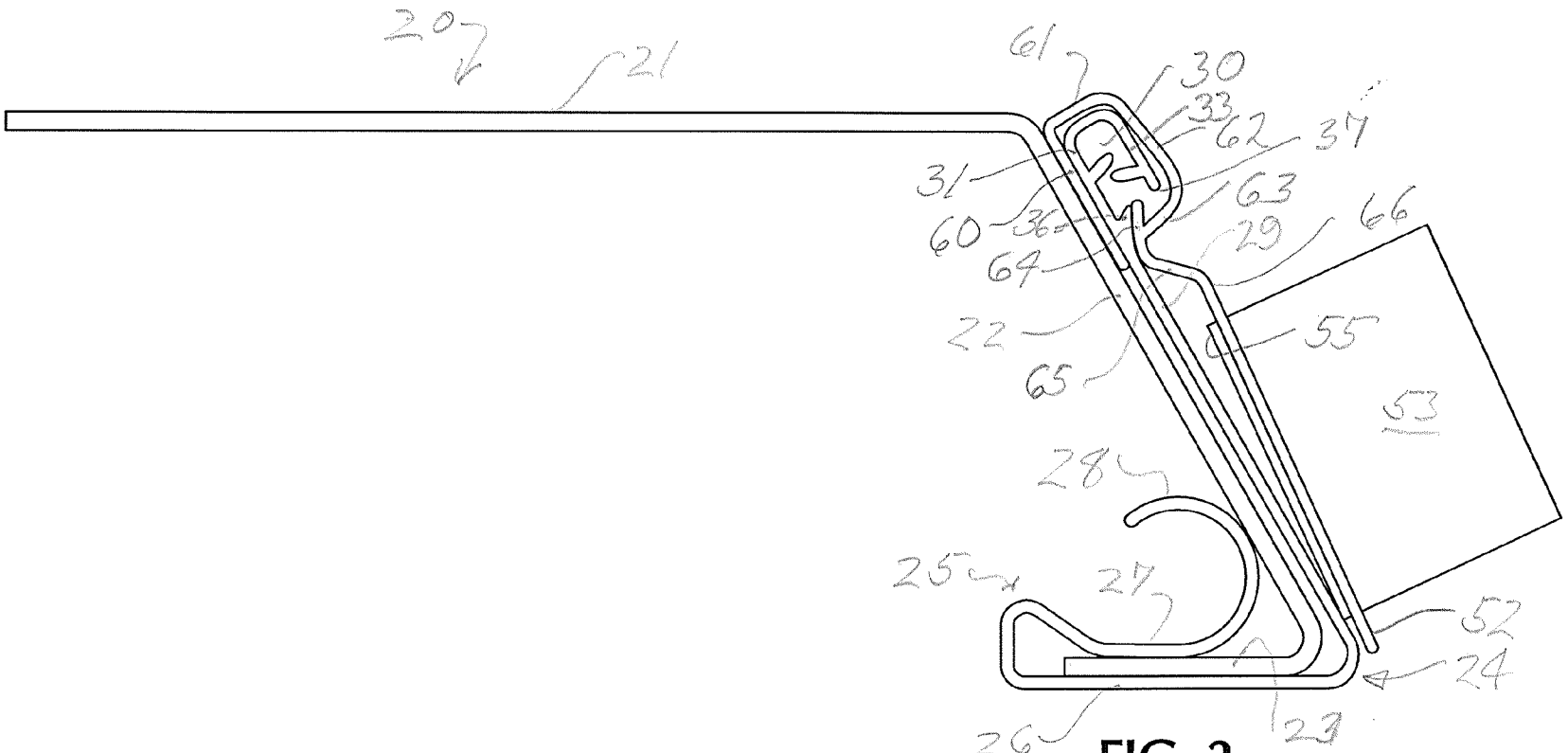
FIG. 2 is an end elevational view of the label holder and sign holder system of the invention.
Figure 4:
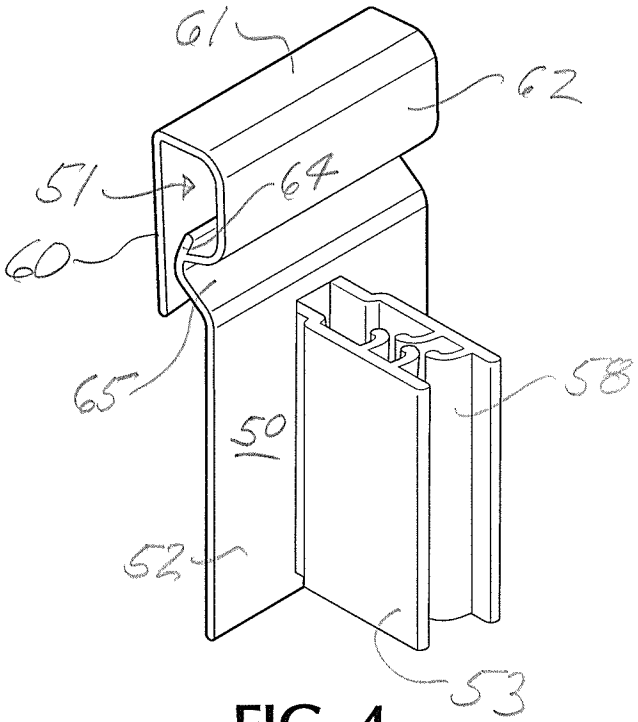
FIG. 4 is an orthographic view of a novel form of sign holder according to the invention.
Figure 3:
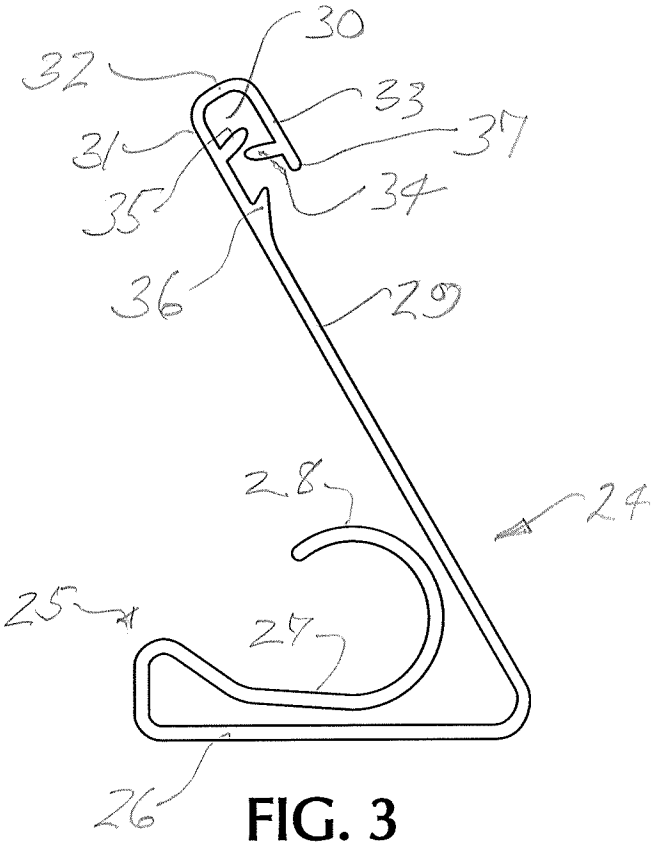
FIG. 3 is an end elevational view of one advantageous form of label holder.
Figure 6:
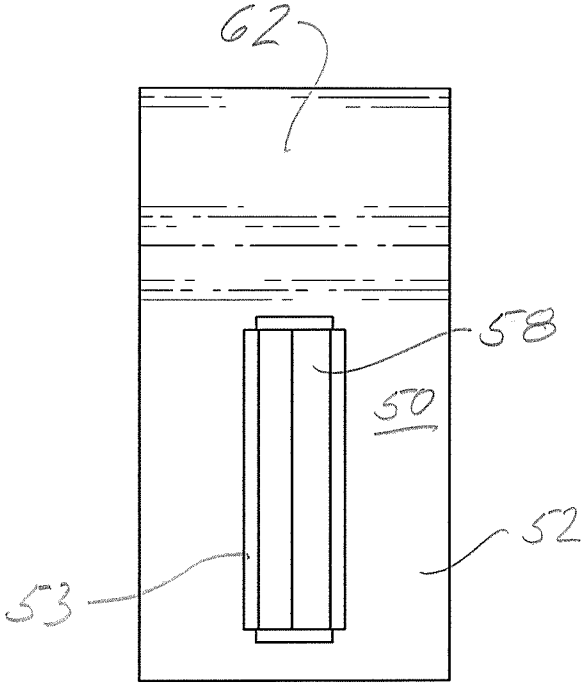
FIG. 6 is a front elevational view of the sign holder of FIG. 4.
Figure 5:
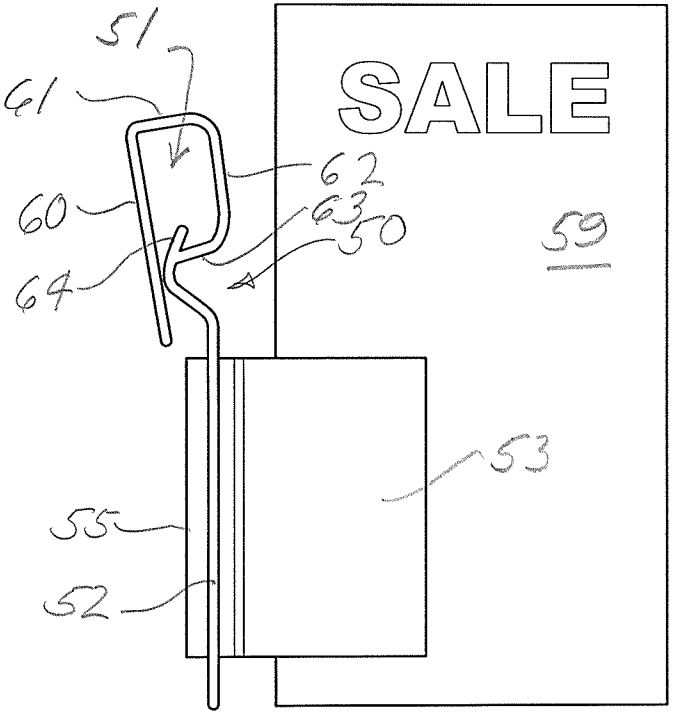
FIG. 5 is a end elevational view of the sign holder of FIG. 4.
Figure 9:
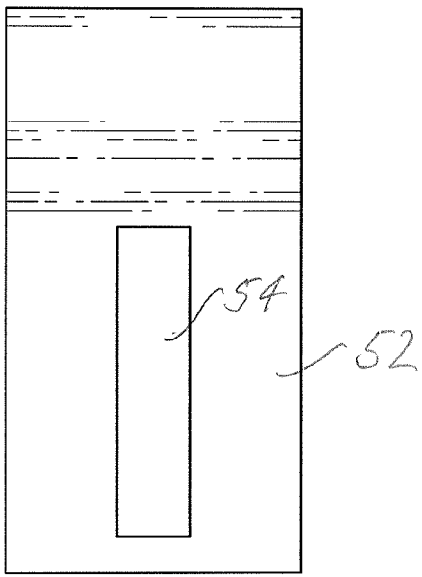
FIG. 9 is a front elevational view of the mounting clip portion and sign clip mounting panel before mounting of the sign clip thereon.

As shown particularly in FIGS. 2 and 3, the label holder 24 includes an upwardly and rearwardly extending label display front panel 29, which is connected to a forward edge of the lower base clip flange 26 and extends upward to a position close to but usually not beyond the upper shelf panel 21 (FIG. 2). The angle between the lower flange 26 and the label support panel 29 is approximately the same as the angle between the front panel 22 and lower flange 23 of the shelf, and preferably may be a few degrees smaller than that angle such that the upper extremities of the label holder are in resilient contact with upper portions of the shelf front panel 22 when the label holder is properly mounted and secured by the base clip 25. The front panel 29 can be flexed forward at the top to allow standard pricing labels to be inserted between it and the front panel 22 of the shelf.

In the illustrated and preferred form of the invention, a sign-gripping socket or cavity 30 is formed at the upper edge of the label holder 24. The cavity 30 includes an upper margin 31 of the label display panel 29, an upper flange 32 extending outward from the upper margin 31 and a forward flange 33 extending downward from the first flange. The forward flange is spaced forwardly from and overlies the panel margin 31, forming a downwardly opening cavity 30 of generally inverted U-shaped configuration, which is open at the bottom.

On the inside walls of the cavity 30 there are soft, flexible projections 34, 35. The projections overlap slightly and can be displaced by the upper edge of a sign card (not shown) pressed upwardly into the cavity 30. The projections 34, 35 are of a softer, more flexible material than the more rigid plastic material of the remainder of the label holder, and can be co-extruded therewith. For example see Nagel U.S. Pat. No. 6,266,906, and No. 6,708,436, the contents of which are incorporated herein by reference.

In accordance with aspects of the invention, an upwardly and outwardly inclined projection 36 is formed at the front surface of the label display panel 29 slightly below the lower extremity 37 of the forward flange 33. The purpose and function of the projection 36 will become apparent later in the description.

Figure 8:
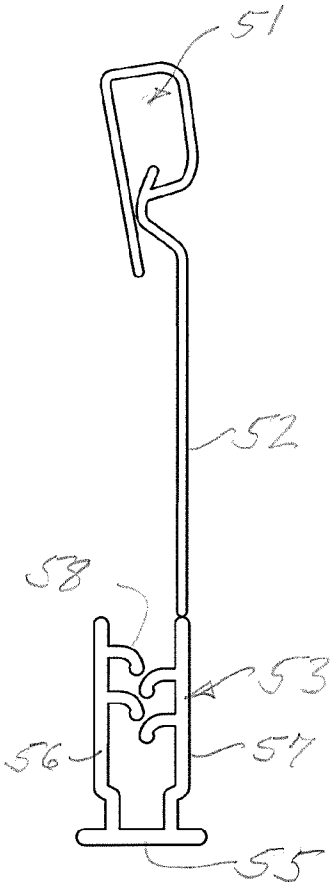
FIG. 8 is an end view showing an extruded form of the sign holder components.
Figure 7:
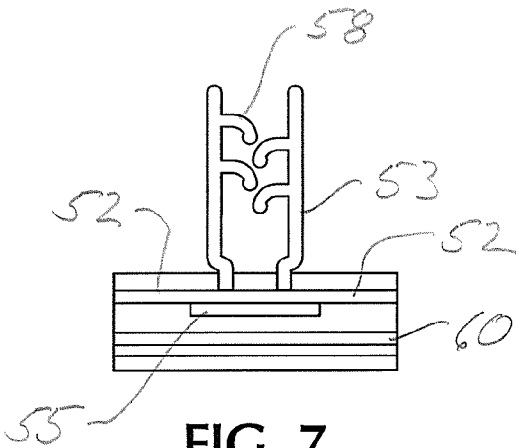
FIG. 7 is a bottom view of the sign holder of FIG. 4.

An advantageous form of sign holder 50 according to the invention is illustrated in FIGS. 4-9. The sign holder 50 has three primary components: a mounting clip portion 51, a sign clip mounting panel 52, and a sign clip 53. Conveniently, these three components can be extruded in one shape, as shown in FIG. 8. After the extrusion operation, the sign clip 53 is broken away from its attachment to the mounting panel 52, and a cut out 54 is formed in the panel 52 to receive the clip 53 with a snap fit assembly. In this respect, the back flange 55 of the sign clip is larger than the opening while the opposed front panels 56, 57 of the clip may be squeezed together and forced through the opening 54. Once through the opening and expanded, the clip is for all practical purposes permanently installed. The sign clip 53 is provided internally with one or more pairs of soft flexible projections 58 which engage and grip a sign card 59 (FIG. 5) and hold it at right angles to the mounting panel 52.

In accordance with the invention, the mounting clip portion 51 of the sign holder comprises a back flange 60 which is joined at its upper edge with a forwardly extending top flange 61. A downwardly extending front flange 62 joins with an outer edge of the top flange 61 and extends downward in generally parallel relation to the back flange 60. The front flange 62 of the mounting clip portion joins at a lower edge thereof with a bottom flange 63 which is positioned slightly below the lower extremity 37 of the forward flange 33 forming the sign-gripping cavity 30.

As shown in FIG. 2, the mounting clip portion 51 is closely received over the top of the label holder 24, generally enveloping the portions of the label holder defining the sign-gripping cavity 30. The back flange 60 is inserted between the front face of the shelf panel 22 and the upper margins 31 of the label display panel 29, as illustrated in FIG. 2, and is gripped lightly between the label display panel 29 and the shelf front panel 22.

At its inner edge, the bottom flange 63 of the mounting clip portion 51 joins with an upper margin 64 of the sign clip mounting panel 52. To advantage, this upper margin 64 is disposed at an angle which corresponds closely to the angle of the inclined projection 36, such that the surfaces of the portions 36, 64 are in surface contact over a short distance when the mounting clip portion is installed over the top edge of the label holder, as shown in FIG. 2.

Desirably, the geometry and spacing of the elements 36, 63 and 64 is such that, when the mounting clip portion 51 is installed, the bottom flange 63 and front flange 62 of the mounting clip portion are resiliently displaced outwardly somewhat. This has two desirable effects: it tends to always keep the sign holder properly seated on the top of the label holder, by urging it downward; also, it provides a degree of friction between the engaging surfaces of the elements 36 and 64 to inhibit unintended lateral movement of the sign holder along the label holder. In this respect, it will be understood that the label holder may be an extrusion of considerable length, such as 48 inches, to correspond with the length of standard gondola shelving, while the sign holder is of relatively narrow width, for example ¾ inch. In the illustrated form of the invention, an upper portion 65 of the sign clip mounting panel is inclined downwardly and outwardly, away from the front panel 29 for a short distance.

Installation of a sign holder onto a label holder is simple and expeditious. The back flange 60 is spread open relative to the front flange 62 and inserted behind the sign grip cavity 30. The outwardly inclined surface 65 can facilitate the installation by helping to "cam" open the mounting clip portion as it is slipped over the top of the label holder. When the inclined portion 64 has passed over the lower extremity 37 of the cavity-forming flange 33 the mounting clip portion closes to the position shown in FIG. 2, with the inclined portion 64 in contact with the inclined projection 36 of the label holder.

Accidental dislodgment of the sign holder is effectively prevented by an upwardly projecting end of the inclined portion 64, which will catch on the inside of the cavity 30 in the case of any accidental upward displacement of the sign holder. In order to intentionally remove the sign holder from the label holder, the lower portion of the sign holder panel 52 must be lifted to open up the mounting clip portion 51 until the inclined portion can clear the extremity 37 at the front of the label-receiving cavity.

One of the particularly advantageous features of the invention is that one or several sign holders may be mounted on a label holder strip and allowed to remain on the strip even when no sign card is displayed. Any sign holders that do not support a sign card can simply be moved laterally, if necessary, to an inconspicuous location and allowed to remain there until there is a need to display one or more signs. A sign holder can, if necessary, easily be slid over any sign cards gripped in the cavity 30, by lifting the sign clip mounting panel 52 sufficiently that the inclined upper portion 64 of the panel clears the front of any sign card extending out of the cavity 30.

The system of the invention eliminates the time otherwise involved in fetching sign clips from a storage location, which may involve finding and selecting a proper sized clip for a particular label holder. Frequently, with existing systems, the unused clips are haphazardly stored and lost or misplaced. This involves extra time of the store personnel in attempting to set up special signage and can sometimes result in the signage not being placed at all. With the system of the present invention, the sign clips can remain at all times mounted on the label holders, ready to be positioned where needed or desired and ready to receive sign cards as desired, whenever appropriate. Whenever necessary or desirable, however, a sign holder may be removed from a label holder and stored in a conventional way, or perhaps on another label holder.

It should be understood, of course, that the specific embodiments of the invention herein illustrated and described are intended to be representative only and not in any way limiting of the invention. By way of example and not of limitation, the sign holder concept of the invention may be utilized with a wide variety of label holders. Likewise, the sign holder of the invention may be combined with a variety of forms of sign clips or, in appropriate cases, with no sign clip but displaying information from a front surface of the panel 52. Accordingly, reference should be made to the following appended claims in determining the full scope of the invention.

What is claimed is:

1. A label holder and sign holder system for mounting at a front edge of a merchandise display shelf, which comprises an extruded label holder formed of plastic material and including a label display panel arranged to overlie the front edge of said shelf and a mounting portion for securing a lower portion of said label display panel to said display shelf, a sign grip integrally formed at an upper edge of said label display panel and comprising an upper margin of said label display panel, an upper flange extending forward from said upper margin and a forward flange extending downward from a said upper flange and overlying said upper margin of said label support panel in spaced relation thereto to form a downwardly opening sign-receiving cavity, at least one of said forward flange and said upper margin of said label display panel having a flexible element mounted thereon within said cavity and extending toward the other of said flange or margin for receiving and retaining an upper edge portion of a sign card, said label holder being of a length to extend along a full length of a shelf section or a substantial portion thereof, and a movable sign holder mounted at the front of said label holder, said sign holder being extruded of a plastic material and having a width which is a small fraction of the length of said label holder, said sign holder comprising a mounting clip portion at an upper edge thereof and a sign mounting panel extending downward from said mounting clip portion, said mounting clip portion comprising a downwardly extending back flange, a top flange extending outwardly from an upper edge of said back flange, a front flange extending downwardly from a forward edge of said top flange, and a bottom flange extending rearward from a lower edge of said front flange, a space between the front and back flanges of said sign holder being at least as great as a front-to-back thickness of said sign grip, and a space between a rearward edge of said bottom flange and said back flange being less than said thickness, said front and back flanges of said sign holder having a resiliently flexible association, such that said front flange and bottom flange may be temporarily displaced outward from said back flange to enable said back flange to be inserted behind upper portions of said label display panel and said bottom flange to be positioned below the forward flange of said sign grip to releasably lock said sign holder together with said label holder, said sign holder being slidable laterally along the length of said label holder while being lockingly connected thereto.

2. A label holder and sign holder system according to claim 1, wherein said sign mounting panel is integrally joined with the bottom flange of said mounting clip portion and extends downward therefrom.

3. A label holder and sign holder system according to claim 2, wherein said sign mounting panel is formed with an opening therein, and a sign clip extends through said opening and projects forwardly therefrom for supporting a sign card at right angles to the front edge of said display shelf.

4. A label holder and sign holder system according to claim 2, wherein said label support panel, in a region thereof generally opposite the bottom flange of said mounting clip portion, is formed with an upwardly and forwardly inclined projection, and an upper extremity of said sign mounting panel rests against said inclined projection.

5. A label holder and sign holder system according to claim 4, wherein the upper extremity of said sign mounting panel extends above said bottom flange.

6. A label holder and sign holder system according to claim 4, wherein the upper extremity of said sign mounting panel is disposed at an angle corresponding to the inclined orientation of the said inclined projection, to lie relatively flat on the surface of said inclined projection, and the upper extremity of said sign mounting panel having a lower portion extending below said bottom flange, and the lower portion of said upper extremity lies in a common inclined orientation with said upper portion thereof and rests upon said inclined projection.

7. A label holder and sign holder system according to claim 4, wherein the inclined upper extremity of said sign mounting panel co-acts with said inclined projection to urge said mounting clip portion downward with respect to said sign grip.

8. A label holder and sign holder system according to claim 1, wherein said label holder is mounted by a bottom portion thereof to said display shelf, with upper portions of said label support panel being displaceable forwardly to accommodate insertion and lateral movement of said sign holder.

9. A label holder and sign holder system for mounting at a front edge of a merchandise display shelf, which comprises an extruded label holder formed of plastic material and including a label display panel arranged to overlie the front edge of said shelf and a mounting portion for securing a lower portion of said label display panel to said display shelf, a forwardly projecting enlargement formed at an upper edge of said label holder, said label holder being of a length to extend along a full length of a shelf section or a substantial portion thereof, and a sign holder mounted at the front of said label holder, said sign holder being extruded of a plastic material and having a width which is a small fraction of the length of said label holder, said sign holder comprising a mounting clip portion at an upper edge thereof and a sign mounting panel extending downward from said mounting clip portion, said mounting clip portion comprising a downwardly extending back flange, a top flange extending outwardly from an upper edge of said back flange, a front flange extending downwardly from a forward edge of said top flange, and a bottom flange extending rearward from a lower edge of said front flange below a bottom of said forwardly projecting enlargement, a space between the front and back flanges of said sign holder being at least as great as a front-to-back thickness of said forwardly projecting enlargement, and a space between a rearward edge of said bottom flange and said back flange being less than said thickness, said front and back flanges of said sign holder having a resiliently flexible association, such that said front flange and bottom flange may be temporarily displaced outward from said back flange to enable said back flange to be inserted behind upper portions of said label display panel and said bottom flange to be positioned below said forwardly projecting enlargement to releasably lock said sign holder together with said label holder, said sign holder being slideable laterally along the length of said label holder while being lockingly connected thereto.

10. A label holder and sign holder system according to claim 9, wherein said forwardly projecting enlargement comprises a downwardly opening cavity for the reception and retention of an upper edge of a sign card.

11. A label holder and sign holder system according to claim 10, wherein said downwardly opening cavity comprises a forward flange portion of said label holder extending downward from an upper portion thereof and spaced outward from said label display panel said label display panel, in a region thereof generally opposite the bottom flange of said mounting clip portion, is formed with an upwardly and forwardly inclined projection, an upper portion of said sign mounting panel rests upon said inclined projection and is disposed at an angle to lie relatively flat on the surface of said inclined projection, and said upper portion includes an upwardly projecting portion positioned rearwardly of and slightly below a lower end of said forward flange portion in a position to be engaged by said forward flange portion upon unintended upward displacement of said sign holder.

12. A label holder and sign holder system according to claim 9, wherein said label display panel, in a region thereof generally opposite the bottom flange of said mounting clip portion, is formed with an upwardly and forwardly inclined projection, and an upper portion of said sign mounting panel rests upon said inclined projection and is disposed at an angle to lie relatively flat on the surface of said inclined projection.

13. A label holder and sign holder system according to claim 9, wherein said merchandise display shelf is of a type comprising a horizontal upper surface, a downwardly and forwardly inclined front panel, and a bottom flange extending horizontally rearward from a bottom of said front panel, said label holder is formed at a bottom thereof with a clip structure engageable with said bottom flange for mounting of said label holder on said display shelf, and upper portions of said label display panel are displaceable forwardly from said front edge panel to enable insertion of said back flange behind said label display panel.

14. A label holder and sign holder system according to claim 9, wherein a sign clip is mounted on said sign mounting panel and extends outwardly therefrom at right angles thereto.

15. A label holder and sign holder system according to claim 14, wherein said sign mounting panel has an opening formed therein, and said sign clip is mounted in said opening and extends outwardly therefrom.

* * * * *